US011933047B2

(12) United States Patent
Thomson

(10) Patent No.: US 11,933,047 B2
(45) Date of Patent: Mar. 19, 2024

(54) PARTITION PANEL

(71) Applicant: ULTRAFRAME (UK) LIMITED, Clitheroe (GB)

(72) Inventor: Andrew Thomson, Clitheroe (GB)

(73) Assignee: ULTRAFRAME (UK) LIMITED

( * ) Notice: Subject to any disclaimer, the term of this patent is extended or adjusted under 35 U.S.C. 154(b) by 45 days.

(21) Appl. No.: 17/268,826

(22) PCT Filed: Aug. 9, 2019

(86) PCT No.: PCT/GB2019/052258
§ 371 (c)(1),
(2) Date: Feb. 16, 2021

(87) PCT Pub. No.: WO2020/035665
PCT Pub. Date: Feb. 20, 2020

(65) Prior Publication Data

US 2021/0372125 A1 Dec. 2, 2021

(30) Foreign Application Priority Data

Aug. 16, 2018 (GB) ..... 1813409

(51) Int. Cl.
*E04C 2/38* (2006.01)
*E04B 1/80* (2006.01)
(Continued)

(52) U.S. Cl.
CPC ..... *E04C 2/38* (2013.01); *E04B 1/80* (2013.01); *E04C 2/46* (2013.01); *E04C 2002/004* (2013.01)

(58) Field of Classification Search
CPC ..... E04C 2/38; E04C 2/46; E04C 2002/004; E04C 2/296; E04C 2/386; E04C 2/20;
(Continued)

(56) References Cited

U.S. PATENT DOCUMENTS 3,355,203 A * 11/1967 Stauffer ..... E04B 1/7666 52/712
6,487,825 B1 * 12/2002 Sillik ..... E04B 1/7666 52/406.1
(Continued)

FOREIGN PATENT DOCUMENTS

DE 2700468 B * 6/1978 ..... E04D 13/1631
DE 7824307 U 12/1978
(Continued)

OTHER PUBLICATIONS

International Search Report and Written Opinion for Application No. PCT/GB2019/052258, dated Oct. 23, 2019, 8 pages.
(Continued)

*Primary Examiner* — Adriana Figueroa
(74) *Attorney, Agent, or Firm* — Barnes & Thornburg LLP

(57) ABSTRACT

A panel for forming part of a partition is disclosed. The partition may, for example, be a roof, a wall or a floor of a building. The panel comprises: a central panel; two support members; and a resiliently compressible portion. The two support members are disposed on opposed sides of the central panel, each of the two support members extending generally perpendicularly to a plane of the central panel. The resiliently compressible portion is arranged between the two support members such that a distance between the two
(Continued)

support members can be reduced by compressing the resiliently compressible portion.

13 Claims, 8 Drawing Sheets

(51) Int. Cl.
*E04B 2/00* (2006.01)
*E04C 2/00* (2006.01)

(58) Field of Classification Search
CPC ..... E04C 2/50; E04C 2/30; E04B 1/80; E04B 7/22; E04B 2001/7695; E04D 13/16; E04D 13/1625
See application file for complete search history.

(56) References Cited

U.S. PATENT DOCUMENTS

| | | | | |
|---|---|---|---|---|
| 2002/0144480 | A1* | 10/2002 | Sagnard | E04D 13/1631 428/57 |
| 2010/0095625 | A1* | 4/2010 | Boutaghou | B32B 5/022 52/309.4 |

FOREIGN PATENT DOCUMENTS

| | | | | |
|---|---|---|---|---|
| DE | 3032867 | A1 * | 4/1982 | |
| DE | 3105681 | A1 | 9/1982 | |
| DE | 3106299 | A1 * | 9/1982 | |
| DE | 3423860 | A1 * | 2/1986 | |
| DE | 3423860 | A1 | 2/1986 | |
| DE | 3933108 | A1 | 4/1991 | |
| DE | 29511659 | U1 * | 1/1996 | |
| DE | 4437458 | A1 | 5/1996 | |
| GB | 2240123 | A * | 7/1991 | E04B 1/7654 |
| JP | 2008196270 | A | 8/2008 | |
| NL | 7800197 | A1 | 7/1978 | |
| NL | 1000049 | C1 * | 5/1995 | |

OTHER PUBLICATIONS

Search Report for Application No. GB1813409.8, dated Jan. 24, 2019, 2 pages.

* cited by examiner

PARTITION PANEL

The present invention relates to a panel for forming part of a partition. The partition may be a thermally insulating or sound insulating partition. The partition may, for example, form part of a building and may be a roof, a wall or a floor.

Buildings generally comprise a plurality of partitions, which may be generally planar objects such as roofs, walls or floors. Such partitions may generally be formed from a support structure (which may, for example, be load bearing). This support structure may be clad on one or both sides with, for example, sheet materials or the like.

It is desirable to provide a panel, which may form part of a partition, that at least partially addresses one or more of the problems of the prior art, whether identified herein or elsewhere.

According to a first aspect of the present invention there is provided a panel for forming part of a partition, the panel comprising: a central panel; two support members disposed on opposed sides of the central panel, each of the two support members extending generally perpendicularly to a plane of the central panel; and a resiliently compressible portion arranged between the two support members such that a distance between the two support members can be reduced by compressing the resiliently compressible portion.

The panel according to the first aspect of the invention is advantageous, since the resiliently compressible portion allows the panel to be temporarily configured in a smaller, compressed state (by compressing the resiliently compressible portion) such that it can be positioned in a space. Subsequently, the resiliently compressible portion can return to its equilibrium length and the panel may expand to substantially fill a gap within which it has been installed.

Advantageously, the resiliently compressible portion allows the panel according to the first aspect of the invention to be used to account for building tolerances in the manufacture of a partition, as now discussed.

The first aspect of the invention provides a construction panel wherein structural support is provided by the two support members placed on opposite sides of the central panel, which may, for example, be formed from a thermally insulating material. It will be appreciated that the panel may form part of a partition, for example a roof, a wall or a floor of a building. It will be appreciated that the panel may be used to cover a space, for example a rectangular space. In use, the panel may be installed such that each of the two support members is supported at either end by a support object (e.g. a wall, a support beam or the like). The two supporting objects may be separated in a first direction. It may be desirable for the panel to substantially fill a space in a second direction that is generally parallel to these support objects and generally perpendicular to the first direction (this space may, for example, be formed between two similar panels in a modular partition system). It will be appreciated that it may be desired that a dimension of the panel in the second direction generally matches the space in this direction. However, generally some building tolerance should be made since, in practice, the desired or required dimension (which is generally dependent on other parts of a building) will not be precisely known. That is, typically such a panel would be manufactured such that it is slightly smaller than the space it is desired to fill by an amount such that an installer can be confident that it will fit into the space and can actually be installed.

The resiliently compressible portion of the panel according to the first aspect of the invention allows the panel to be temporarily configured in a smaller, compressed state (by compressing the resiliently compressible portion) such that it can be positioned in a space. Subsequently, the resiliently compressible portion can return to its equilibrium length and the panel may expand to substantially fill a gap within which it has been installed.

It will be appreciated that as used herein the terms panel, sheet and board are intended to mean a relatively thin, generally flat three-dimensional object or body. It will be further appreciated that by relatively thin it is meant that one dimension of the object or body is smaller than the other two dimensions of the object or body. The smallest dimension of the object or body may be referred to as its thickness. The two dimensions generally perpendicular to the smallest dimension of the object or body may define a plane (or family of parallel planes). Such panels, sheets and boards may, for example, be generally rectangular. It will be appreciated that, unless stated to the contrary, herein the surfaces or faces of a panel are intended to mean the two surfaces that are separated by the thickness of the panel whereas the sides or edges of a panel are the other surfaces of the panel that are generally parallel to the thickness of the panel.

It will be appreciated that a resiliently compressible portion is intended to mean any object that can be compresses to a smaller size, for example by application of compression forces, and which will return to a starting or equilibrium size once such compression forces are removed.

The resiliently compressible portion may form part of, or be disposed within, the central panel. For example, the central panel may comprise two parts. The resiliently compressible portion may be arranged between said two parts of the central panel.

Alternatively, the resiliently compressible portion may be arranged between the central panel and one of the two support members.

The resiliently compressible portion may be arranged between two parts of the panel and the resiliently compressible portion may be substantially sealed to each of said two parts of the panel.

For example, the resiliently compressible portion may be sealed to each of said two parts of the panel along substantially the entire dimension of the panel (for example in a direction that is perpendicular to a direction that extends between the two support members).

Advantageously, this may ensure that there are no gaps in the panel, or a partition that the panel forms part of.

Alternatively, some embodiments may have no such seal. For such alternative embodiments, once the panel according to the first aspect of the invention has been installed, an additional filler material (for example expanding foam or the like) could be used to ensure that there are no gaps in the panel, or a partition that the panel forms part of.

The resiliently compressible portion may comprise one or more foam strips that are disposed between, and adhered to, two other parts of the panel.

Foam is beneficial since it can provide the panel with some resilient compressibility whilst still being substantially sealed to each of two other parts of the panel between which it is disposed.

The foam may comprise polyurethane foam. It may be preferable for the or each foam strip to comprise an open cell foam, which may provide better elasticity for the resiliently compressible portion.

Alternatively, the resiliently compressible portion may comprise one or more compression springs that may be disposed between, and adhered to, two other parts of the panel.

The resiliently compressible portion may comprise two foam strips, each of the two foam strips being disposed adjacent a different one of two opposed surfaces of the panel.

The panel may further comprise a retaining means for retaining the resiliently compressible portion in a compressed state.

Advantageously, the retaining means may allow the panel to be provided in a first, compressed state while the panel is positioned in a space. Subsequently, the retaining means can be released such that the resiliently compressible portion can return to its equilibrium length and the panel may expand to substantially fill a space within which it has been installed.

The resiliently compressible portion may be maintained in the compressed state by the retaining means.

The retaining means may comprise one or more straps. The straps may be of the form of standard packing straps. The straps may be formed from any suitable material including, for example, plastics materials and/or metals.

The central panel may comprise a thermally insulating material. For example, the material may be a rigid insulation material such as, for example, expanded polystyrene (EPS), extruded polystyrene (XPS), rigid polyurethane (PUR), polyisocyanurate (PIR). The material may be either closed cell or open cell. Such embodiments, wherein the central panel comprises a thermally insulating material, may be particularly suitable when the panel forms part of a roof or an external wall of a building.

Alternatively, particularly for embodiments when the panel forms part of an internal wall or floor of a building, the central panel may comprise a cheap material that merely provides a connection between the two support members of the panel. For example, the material may comprise cardboard.

In some embodiments, the central panel may comprise a sound insulating material. Such embodiments may be particularly suitable when the panel forms part of an internal wall or floor of a building.

The two support members may each comprise a support panel extending generally perpendicularly to a plane of the central panel.

The support panels may be formed from any suitable material. Suitable materials may include hardboard and high density fibreboard (HDF).

Optionally, the support panels may be bonded to the central panel using a suitable adhesive. This may keep the elements of the panel together thus making transportation of the panel (for example to a construction site) easier.

A protruding portion of each of the two support members may extend beyond at least one of the faces of the central panel.

Since each of the support members extends beyond at least one of the sides of the central panel, a partition formed from a plurality of panels of this form does not have a smooth, flat surface. Rather, the protruding portions of the support panels from each pair of adjacent panels form a ridge on each surface of the partition (which is generally defined by the surfaces of the central panels).

The panel may further comprise a reinforcing member at least on the or each protruding portion of the support members.

The or each reinforcing member may be structurally connected to the support panel in any suitable way.

The or each reinforcing member may comprise a metal. For example, the or each reinforcing member may comprise a rolled light gauge steel strip which is mechanically attached to the support panel (which may be formed from a better thermally insulating material such as hardboard).

A side surface of either or both of the support panels may be provided with a resilient sealing material.

For example, a foam tape or the like may be applied to one or both sides of the panel. In use, this can enhance the sealing of adjacent panels.

The panel according to the first aspect of the invention can form part of a modular partition system comprising a plurality of panels. In such modular partition system, the panels may each be generally of the form of the panel of the first aspect of the invention although some of the panels may be provided with a resiliently compressible portion whereas some may have no resiliently compressible portion. In general, at least one of the panels may be provided with a resiliently compressible portion.

According to a second aspect of the invention there is provided a modular partition system comprising: a plurality of panels, each of the plurality of panels comprising two support members extending generally perpendicularly to a plane of the modular partition system and a central panel extending between said two support panels, the plurality of panels being arranged such that the central panels of each of the plurality of panels are generally mutually parallel and one support member of each of the plurality of panels is adjacent to a support member of an adjacent panel; and at least one connecting strip; wherein the at least one connecting strip cooperates with a support member from each of two of the plurality of adjacent panels so as to connect said two of the plurality of adjacent panels; and wherein at least one of the plurality of panels is a panel according to the first aspect of the invention.

In such a modular partition system, the panels may be installed such that each of the two support panels is supported at either end by a support object (e.g. a wall, a support beam or the like). A plurality of panels may be arranged such that the central panels of each of the plurality of panels are generally mutually parallel and one support member of each of the plurality of panels is adjacent to a support member of an adjacent panel.

The two support members of each panel can form a load bearing structure of the partition whereas the central panels may be non-load bearing in use and may provide thermal or sound insulation.

Each pair of adjacent panels within the modular system may be connected together via a pair of connecting strips arranged to cooperate with a support member from each of two adjacent panels. The support members of two adjacent panels, along with two connecting strips co-operate to form a self-supporting, load bearing I beam.

Advantageously, the resiliently compressible portion allows the at least one panel according to the first aspect of the invention to be used to account for building tolerances in the manufacture of a partition, as now discussed.

The partition may, for example, be a roof, a wall or a floor of a building. In the manufacture of such a partition comprising a plurality of adjacent panels, the partition may have desired or required dimensions. For example, in the case of a roof, a width of the roof may be set by the positions of two support objects (e.g. walls or support beams or the like) between which the roof spans and, similarly, a height of the roof may be set by the positions of two other such support objects. As a partition is formed from a plurality of panels, each individual panel may span between a first pair two supporting objects (separated in a first direction). Each individual panel is installed in turn and, in so doing, a gap between a second pair of supporting objects (separated in a second direction) is spanned.

It will be appreciated that it is desired that a sum of the dimensions of all of the panels in the second dimension generally matches the gap between the second pair of supporting objects. However, generally some building tolerance should be made since, in practice, the desired or required dimension (which is generally dependent on other parts of a building) will not be precisely known.

The modular partition system may further comprise a resilient seal between each pair of adjacent panels. For example, a side surface of either or both of the two support members may be provided with a sealing material (for example a foam tape or the like).

In at least one direction the at least one connecting strip may extend beyond the support members from the two adjacent panels which it is arranged to cooperate with. This allows the connecting strip to extend beyond the plurality of panels and over, for example, a beam to help with the connection of the modular partition system to the beam and provide a counter batten on a top surface of the beam.

The at least one connecting strip may be provided with one or more engagement features for engagement with a batten and/or a wall tie. This further simplifies constructions which use the modular partition system. When used as a roof, a plurality of battens may be provided on an external surface of the modular partition system to support roof tiles. When used as a wall (for example the inner leaf of a cavity wall), a plurality of wall ties may be provided on an external surface of the modular partition system to connect it to an outer leaf of the cavity wall (for example a brick wall).

According to a third aspect of the invention there is provided a method for installing a panel in a space, the method comprising: providing a panel, the panel comprising: a central panel; two support members disposed on opposed sides of the central panel, each of the two support members extending generally perpendicularly to a plane of the central panel; and a resiliently compressible portion arranged between the two support members such that a distance between the two support members can be reduced by compressing the resiliently compressible portion; compressing the resiliently compressible portion; positioning the panel in the space; and allowing the resiliently compressible portion to return to its equilibrium length.

According to a fourth aspect of the invention there is provided a method for installing a panel in a space, the method comprising: providing a panel, the panel comprising: a central panel; two support members disposed on opposed sides of the central panel, each of the two support members extending generally perpendicularly to a plane of the central panel; and a resiliently compressible portion arranged between the two support members such that a distance between the two support members can be reduced by compressing the resiliently compressible portion, wherein the resiliently compressible portion is in a compressed state; positioning the panel in the space; and allowing the resiliently compressible portion to return to its equilibrium length.

Various aspects and features of the invention set out above or below may be combined with various other aspects and features of the invention as will be readily apparent to the skilled person.

Embodiments of the invention will now be described, by way of example only, with reference to the accompanying schematic drawings in which corresponding reference symbols indicate corresponding parts, and in which.

A novel panel 2 for a partition according to an embodiment of the invention is shown in FIGS. 1A to 2B.

Figure 1A:
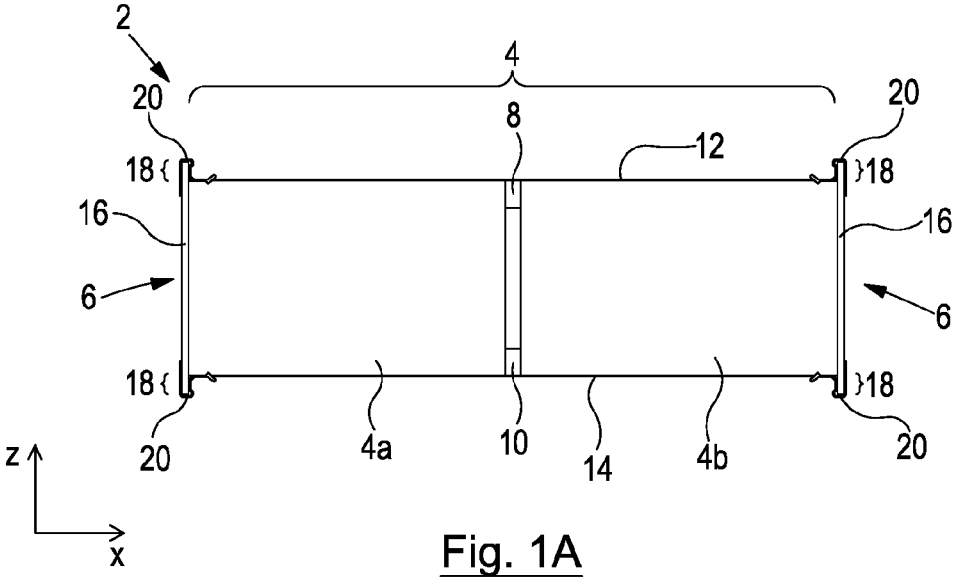
FIG. 1A is a cross sectional view of a panel for a partition according to an embodiment of the invention disposed in an equilibrium state.
Figure 1B:
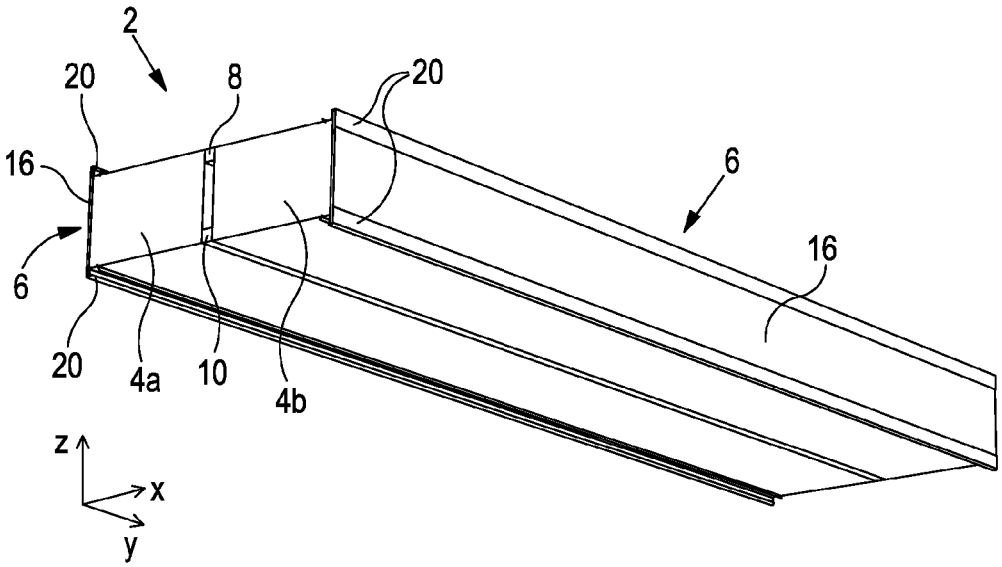
FIG. 1B is a partial cutaway perspective view of the panel shown in FIG. 1A, disposed in the equilibrium state.
Figure 2A:
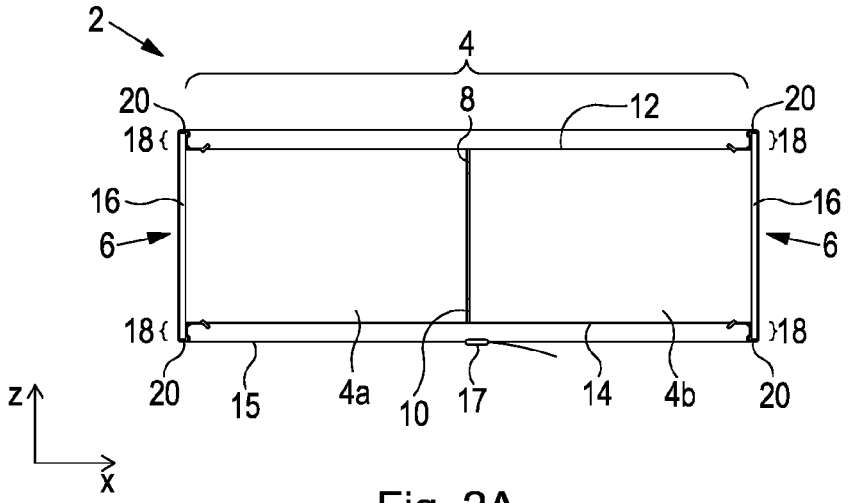
FIG. 2A is a cross sectional view of a panel for the partition shown in FIGS. 1A and 2A, disposed in a compressed state.
Figure 2B:
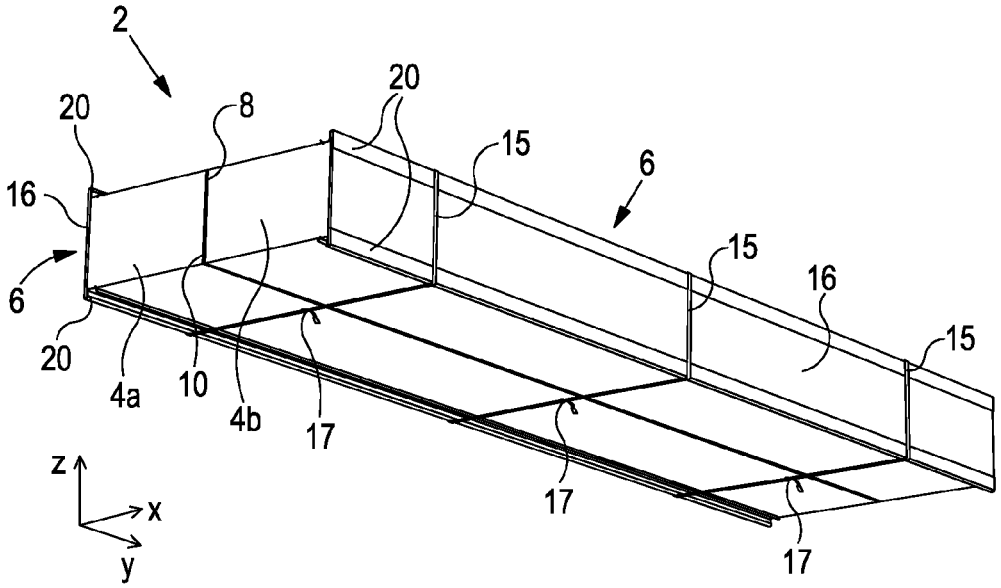
FIG. 2B is a partial cutaway perspective view of the panel shown in FIG. 2A, also disposed in the compressed state.

FIGS. 1A and 2A show cross sectional views of the panel 2 in an equilibrium state and a compressed state respectively. FIGS. 1B and 2B show partial cutaway perspective views of the panel 2 in the equilibrium state and the compressed state respectively and it will be appreciated that these have been cut away such that surfaces of the panel 2 furthest away from a view point of these Figures can be seen.

The panel 2 comprises a central panel 4 and two support members 6. The two support members 6 are disposed on opposed sides of the central panel 4. Each of the two support members 6 extends generally perpendicularly to a plane of the central panel 4.

It will be appreciated that as used herein the term panel is intended to mean a relatively thin, generally flat three-dimensional object or body. It will be further appreciated that by relatively thin it is meant that one dimension of the object or body is smaller than the other two dimensions of the object or body. The smallest dimension of the object or body may be referred to as its thickness. The two dimensions generally perpendicular to the smallest dimension of the object or body may define a plane (or family of parallel planes).

In FIGS. 1A to 2B, the smallest dimension, or thickness, of the central panel 4 is the z-direction. The two dimensions generally perpendicular to the thickness of the central panel 4 may be considered to define the x-y plane. In FIGS. 1A to 2B, the smallest dimension, or thickness, of each of the support members 6 is the x-direction. The two dimensions generally perpendicular to the thickness of the support members 6 may be considered to define the y-z plane. Therefore, each of the two support members 6 extends generally perpendicularly to a plane of the central panel 4.

The central panel 4 comprises: a first insulating panel portion 4*a*, a second insulating panel portion 4*b* and two foam strips 8, 10. The foam strips 8, 10 are disposed between the first and second insulating panel portions 4*a*, 4*b*.

Each of the two foam strips 8, 10 is disposed adjacent a different one of two opposed surfaces 12, 14 of the central panel 4. It will be appreciated that as used herein the surfaces or faces of a panel are intended to mean the two surfaces that are separated by the thickness of the panel.

The two foam strips 8, 10 are formed from a compressible material. Therefore, the two foam strips 8, 10 may be considered to provide a resiliently compressible portion of the panel 2 that is arranged between the two support members 6 such that a distance between the two support members 6 can be reduced by compressing said resiliently compressible portion.

The foam strips 8, 10 may, for example, have a generally square cross-sectional shape of dimensions of 25 mm by 25 mm. A dimension of the foam strips 8, 10 in a direction that is generally parallel to the central panel 4 may be reduced from 25 mm to 3 mm by compression.

The two foam strips 8, 10 may comprise a polyurethane foam. In some embodiments, the foam strips 8, 10 may comprise an open cell foam, which may provide better elasticity for the resiliently compressible portion.

The two foam strips 8, 10 may be adhered to the first and second insulating panel portions 4*a*, 4*b* using a suitable adhesive. The adhesive may, for example, comprise acrylic adhesive, which may be pre-applied to the foam strips 8, 10.

Although in this embodiment, the resiliently compressible portion is provided by two foam strips 8, 10, it will be appreciated that in alternative embodiments the resiliently compressible portion may be provided by any other resiliently compressible object such as, for example, one or more compression springs that may be disposed between, and adhered to, two other parts of the panel 2. However, the use of foam is beneficial for a number of reasons, as not discussed.

First, the foam strips 8, 10 can provide the panel 2 with some resilient compressibility whilst still being substantially sealed to each of the first and second insulating panel portions 4*a*, 4*b* between which they are disposed. For example, the two foam strips 8, 10 may be sealed to each of the first and second insulating panel portions 4*a*, 4*b* along substantially the entire dimension of the panel 2 (for example in a direction that is perpendicular to a direction that extends between the two support members 6, i.e. the x-direction). Advantageously, this may ensure that there are no gaps in the panel 2, or a partition that the panel 2 forms part of.

In this embodiment, the two foam strips 8, 10 (which provide the resiliently compressible portion of the panel 2) may be considered form part of, or be disposed within, the central panel 4. However, it will be appreciated that in alternative embodiments, the resiliently compressible portion may be arranged between the central panel 4 and one of the two support members 6.

As shown in FIGS. 2A and 2B, in some embodiments, the panel 2 may be provided with one or more straps 15. The straps 15 may be of the form of standard packing straps. The straps 15 may be formed from any suitable material including, for example, plastics materials and/or metals. The straps 15 may be formed from an open strap that is wrapped around the panel 2. The panel 2 may be compressed, for example by application of a compression force between the two support members 6. Once compressed, a joint 17 may be formed between the open ends of straps 15. It will be appreciated that this joint 17 is formed with the strap being tensioned around the panel 2. The compression force between the two support members 6 may be applied by the straps 15. Alternatively, the compression force between the two support members 6 may be applied by a different means.

It will be appreciated that the straps 15 may be considered to be a retaining means for retaining the two foam strips 8, 10 (which provide the resiliently compressible portion) are in a compressed state. Advantageously, the straps 15 may allow the panel 2 to be provided in a first, compressed state while the panel 2 is positioned in a space. Subsequently, the straps 15 can be removed such that the two foam strips 8, 10 (which provide the resiliently compressible portion) can return to their equilibrium length and the panel 2 may expand to substantially fill a space within which it has been installed.

In some embodiments, the panel 2 may be marketed in a compressed state with straps 15 in place. The straps 15 can then be removed by a user installing the panel 2. With such embodiments, it may be that the two foam strips 8, 10 are not adhered to the first and second insulating panel portions 4*a*, 4*b* (or each foam strip 8, 10 may be adhered only to one of the first and second insulating panel portions 4*a*, 4*b*). It will be appreciated that for such embodiments the straps 15 may hold the panel 2 together as a single unit.

The first and second insulating panel portions 4*a*, 4*b* may comprise any suitable insulation material. For example, the material may be a rigid insulation material such as, for example, expanded polystyrene (EPS), extruded polystyrene (XPS), rigid polyurethane (PUR), polyisocyanurate (PIR). The material may be either closed cell or open cell. The thickness of the central panel 4 may be determined by bearing in mind building regulations or codes to which it is desired for buildings incorporating the panel 2 to meet. There is a general trend in the construction industry for increasing thicknesses of insulation to be installed in partitions. Merely as an example, the central panel 4 (and therefore the first and second insulating panel portions 4*a*, 4*b*) may have a thickness of the order of 175 mm.

The two support members 6 each comprise a support panel 16. The support panels 16 extend generally perpendicularly to a plane of the central panel 4. The support panels 16 may be formed from any suitable material. Suitable materials may include hardboard and high density fibreboard (HDF).

A protruding portion 18 of each of the two support panels 16 extends beyond the faces 12, 14 of the central panel 4. Therefore, the panel 2 is arranged such that on each of four edges of the panel 2, a protruding portion 8 of one of the support panels 16 stands proud of the central panel 4. Since each of the support members 6 extends beyond at least one of the sides of the central panel 4, a partition formed from a plurality of panels 2 of this form does not have a smooth, flat surface. Rather, the protruding portions 18 of the support panels 16 from each pair of adjacent panels 2 form a ridge on each surface of the partition (which is generally defined by the surfaces 12, 14 of the central panels 4).

The support members 6 further comprise a reinforcing member 20 on each protruding portion 18 of the support panels 16. The reinforcing member 20 comprises a rolled light gauge steel strip 14 provided on each protruding portion 18 of the support panels 16.

The reinforcing members 20 may be structurally connected to the support panels 16 in any suitable way. The support members 6 are described in greater detail below with reference to FIGS. 4 to 6B below.

In FIGS. 1A to 2B, a thickness of the panel 2 is the z-direction. Of the other two dimensions generally perpendicular to the thickness of the panel 2, the dimension which both the central panel 4 and the support panels 16 extend along (i.e. the y-direction) may be considered to be the length of the panel 2 and the other dimension (i.e. the x-direction) may be considered to be the width of the panel 2.

The panel 2 may be of any width. The width of the panel 2 may be selected bearing in mind both: the amount of support required for the overall structural stability of the panel and/or the requirements of any substrate which, in use, the panel 2 is intended to support. For example, in use the panel may support plasterboard (on an interior surface thereof) which is typically supported at a maximum of 600 mm centres.

Therefore, in one embodiment, the panel 2 may have a width of around 600 mm to accommodate this. The support panels 16 may have a thickness of around 6 mm. In order for the overall thickness of the panel 2 to be 600 mm, the width of the central panel 4 will be 588 mm.

The panel 2 shown in FIGS. 1A to 2B and described above provides an insulated construction panel wherein structural support is provided by the two support members 6 placed on opposite sides of the central panel 4.

The support panels 16 may be bonded or adhered to the insulation panel 4. This may be convenient since it may make each panel 2 a more easily transportable assembly. However, since the support panels 16 of the panel 2 extend generally perpendicularly to a plane of the panel 2, there is no need for any load to be transmitted through the central panel 4. Therefore, any connection (for example adhesive bonding) between the support members 6 and the central panel 4 does not need to be of high integrity.

In general, the support members 6 will not have the same thermal performance as the central panel 4 and will typically reduce the thermal performance of the overall assembly in comparison to a construction with insulation alone. To reduce this effect the thickness of the support members 6 may be minimised and the material from which they are formed may be chosen to maximise the thermal performance of the panel 2 whilst fulfilling the structural roll.

The panel 2 may have any length as desired. It has been found that a panel with the features as described above may be able to span distances of around 6.5 m. It is envisaged that the construction of the panel may be such that it will only be cut to length by order. It is expected that this may reduce material waste significantly.

A modular partition system 22 according to an embodiment of the invention is now described with reference to FIGS. 3 and 4.

Figure 3:
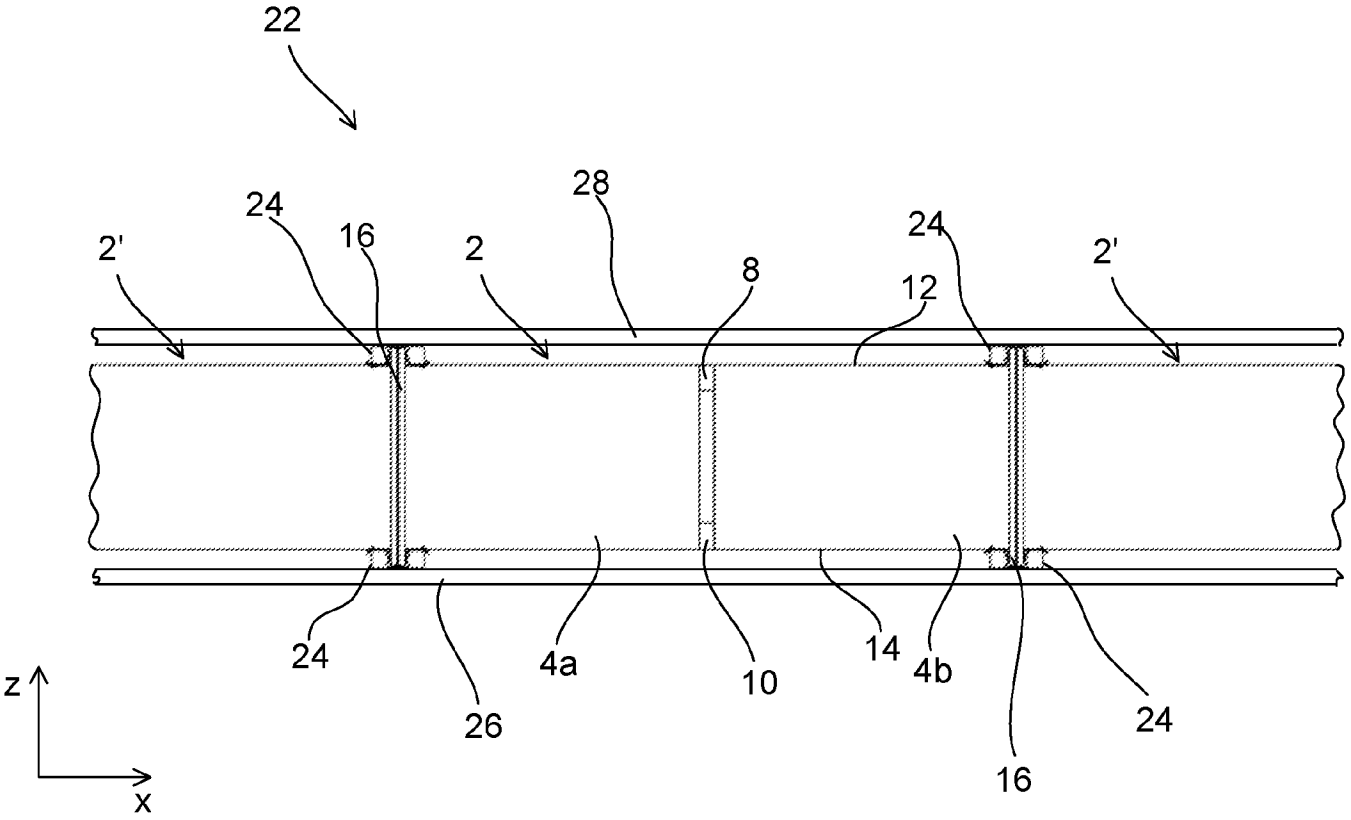
FIG. 3 is a cross sectional view of a portion of a modular partition system according to an embodiment of the invention comprising a panel of the form shown in FIGS. 1A to 2B.

FIG. 3 is a cross sectional view of a portion of the modular partition system 22 according to an embodiment of the invention. The modular partition system 22 comprises a plurality of panels 2, 2'. Three panels 2, 2' are shown in FIG. 15 but it will be appreciated that in alternative embodiments the modular partition system 22 may comprise two or greater than three panels 2, 2'. At least one of the panels 2 comprises a panel of the form described above with reference to FIGS. 1A to 2B. In FIG. 3, a central panel 2 is generally of the form described above with reference to FIGS. 1A to 2B. This central panel 2 is disposed between two side panels 2'.

In some embodiments, the side panels 2' may be generally of form of the panel 2 described above with reference to FIGS. 1A to 2B.

In other embodiments, the side panels 2' may be of a modified form that does not comprise the two foam strips 8, 10 (such that the central panel 4 comprises a single panel portion, which may comprise insulation). For example, the modular partition system 22 may generally comprise such modified panels which do not comprise the two foam strips 8, 10 and only one, or a relatively small number, of panels 2 as described above with reference to FIGS. 1A to 2B may be provided. It will be appreciated that a panel 2 as described above with reference to FIGS. 1A to 2B may be formed from a modified panels which does not comprise the two foam strips 8, 10 by cutting the central insulating panel 4 of the former in half and then placing the two foam strips 8, 10 between said two halves. The two foam strips 8, 10 may be adhered to the two halved of the central insulating panel 4 (which form the first and second insulating panel portions 4*a*, 4*b*) using a suitable adhesive.

The panels 2, 2' are arranged such that the central panels 4 of each of the panels 2, 2' are generally mutually parallel and one support member (i.e. one support panel 16 and two reinforcing members 20) of each of the plurality of panels 2, 2' is adjacent to a support member of an adjacent panel 2, 2'. The modular partition system 22 further comprises two connecting strips 24 for each pair of adjacent panels 2, 2'. Each connecting strip 24 is arranged to cooperate with a support member from each of two of the plurality of adjacent panels 2, 2'.

Generally, on an interior surface of the modular partition system 22, an internal substrate 26 is connected to the panels 2, 2' using one or more fixings (typically screws or nails or the like). The internal substrate 26 may comprise plasterboard, for example 12.5 mm foil backed plasterboard. Each of these fixings passes through a connecting strip 24 and into the reinforcing member 20 of one of the panels 2. Generally, on an exterior surface of the modular partition system 22, an external substrate or roof structure 28 is connected to the panels 2, 2'. There are various different options for such external substrates, as known in the art.

Generally, the connecting strips 24 forms an interference fit with a support members 6 from each of two adjacent panels 2, 2'. Generally, each connecting strip 24 is also mechanically attached to both of the adjacent panels 2, 2' using one or more fixings (for example, punches, rivets, screws, nails or the like).

It will be appreciated that, in use, generally two connecting strips 24 are provided for each pair of adjacent panels 2, 2' the two connecting strips 24 being provided at opposite ends of the support members 6.

Figure 4:
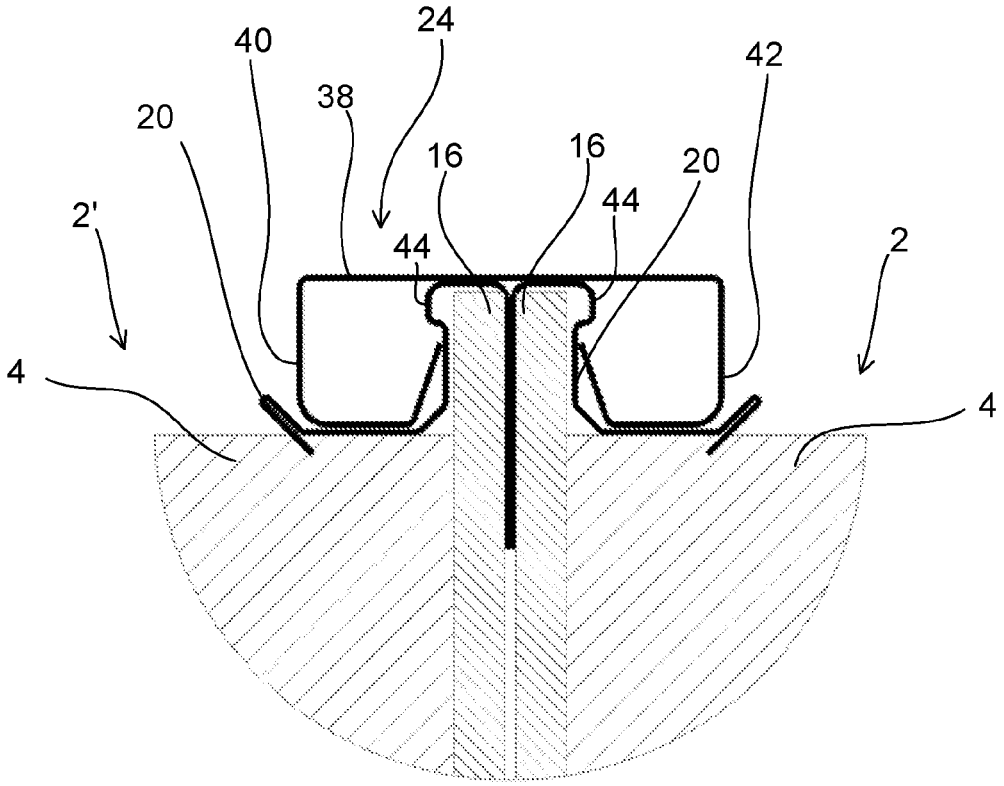
FIG. 4 shows two adjacent panels and a connecting strip which is suitable for engaging with the support members of these two panels, which form part the modular partition system shown in FIG. 3.

FIG. 4 shows two adjacent panels 2, 2' and a connecting strip 24 which is suitable for engaging with flanges of the support members 6 of these panels 2, 2'.

Figure 5B:
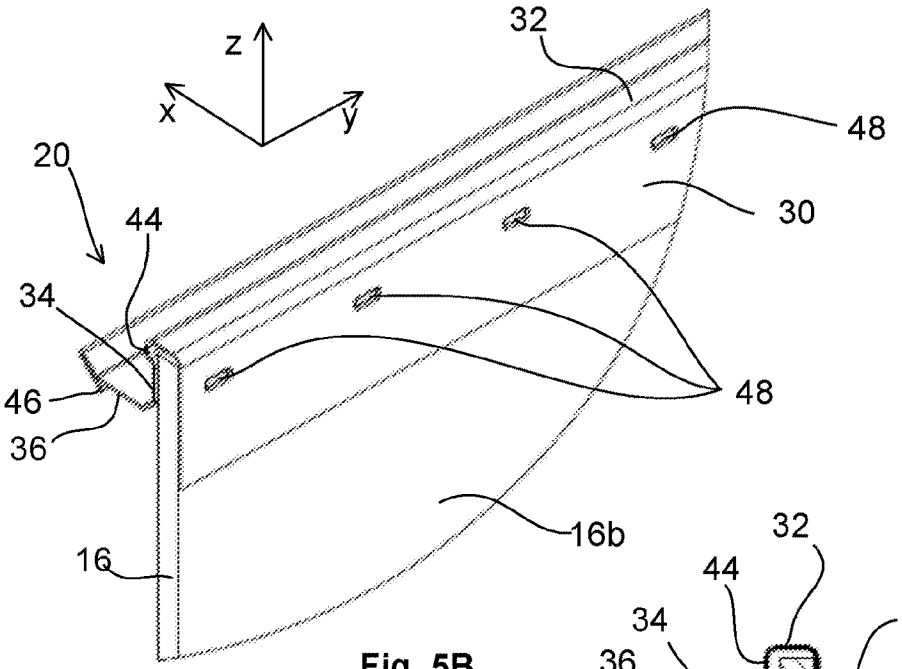
FIG. 5B shows a second perspective view of a portion of the support member of the panel shown in FIGS. 1A to 2B showing a surface of the support panel which in use is distal from the central panel.
Figure 5C:
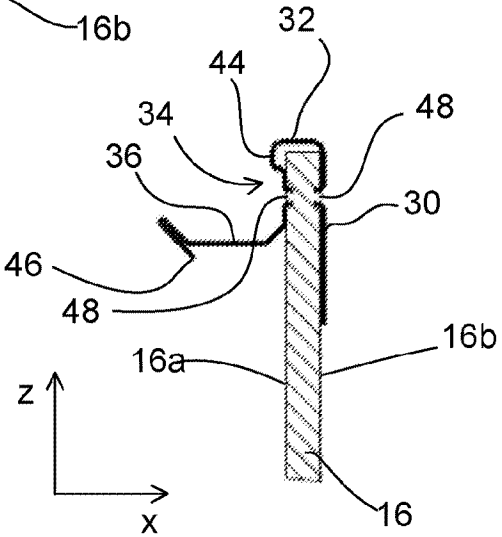
FIG. 5C is a cross-sectional view of the portion of the support member shown in FIGS. 5A and 5B in the x-z plane.
Figure 5A:
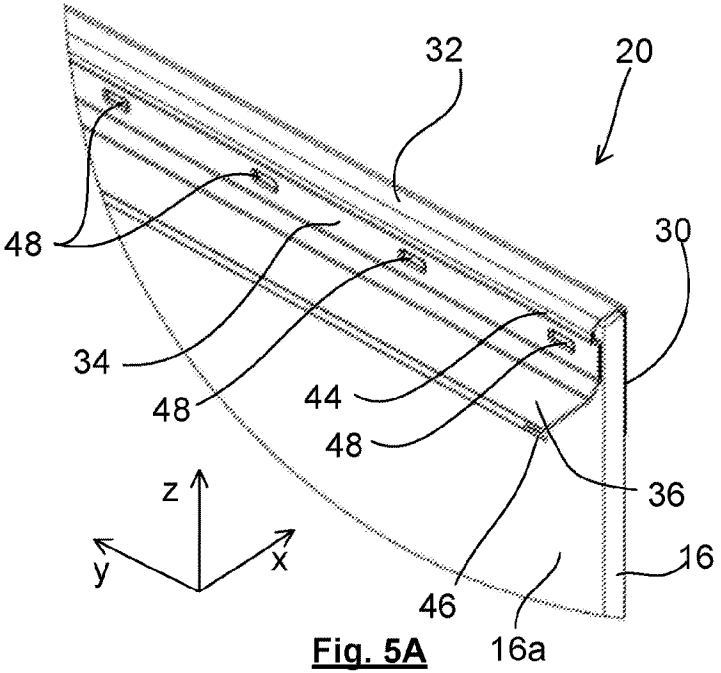
FIG. 5A shows a first perspective view of a portion of a support member of the panel shown in FIGS. 1A to 2B.
Figure 5D:
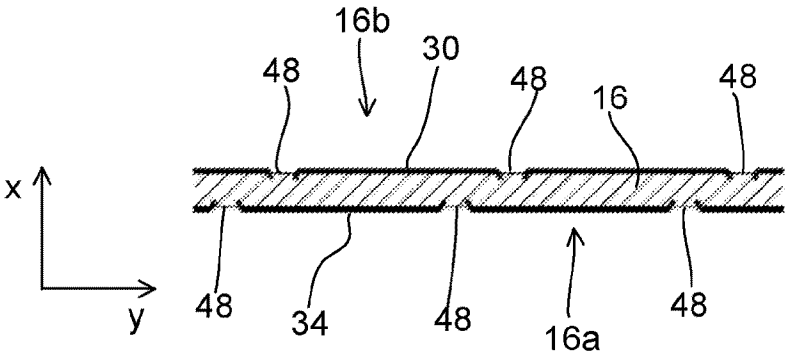
FIG. 5D is a cross-sectional view of the portion of the support member shown in FIGS. 5A and 5B in the x-y plane.

FIGS. 5A-5D show a portion of support member 6 (comprising a support panel 16 and a steel reinforcing member 20). FIG. 5A shows a perspective view showing a surface 16*a* (which may be referred to as an interior surface) of the support panel 16 which in use contacts the central panel 4. FIG. 5B shows a perspective view showing a surface 16*b* (which may be referred to as an exterior surface) of the support panel 16 which in use is distal from the central panel 4. In FIGS. 5A-5D a set of Cartesian coordinate axes is shown which is consistent with those shown in FIGS. 1A to 3, such that the smallest dimension, or thickness, of each of the support panels 16 is the x-direction. The two dimensions generally perpendicular to the thickness of the support panels 16 may be considered to define the y-z plane. The smallest dimension, or thickness, of the central panel (not shown) is the z-direction. FIG. 5C is a cross-sectional view of the support panel 16 and the reinforcing member 20 in the x-z plane and FIG. 11D is a cross-sectional view of the support panel 16 and the reinforcing member 20 in the x-y plane.

As can be best seen in FIG. 5C, the reinforcing member 20 comprises: a first portion 30 which is in contact with and generally parallel to the exterior surface 16*b* of the support panel 16; a second portion 32 which extends generally between the two opposed surfaces 16*a*, 16*b* of the support panel 16; a third portion 34 which is generally parallel to the interior surface 16*a* of the support panel 16; and a fourth portion 36 which extends generally parallel to a surface of the central panel 4.

The connecting strip 24 (see FIG. 4) defines a channel or groove for receipt of the part of the flanges of the support members 6 of two adjacent panels 2, 2' as described above. The profile of the connecting strip 24 is such that it forms an interference fit with the reinforcing members 20 of the support members 6 of the panels 2, 2', as now described.

The connecting strip 24 (which may be formed from rolled steel) is generally of the form of a box beam but having an aperture for receipt of part of the two support panels 16 proximate an edge thereof and part of the reinforcing members 20 proximate the edges of the support panels 16. In particular, the connecting strip 24 comprises a central wall portion 38 and two generally U-shaped side portions 40, 42. The channel or groove for receipt of part of the flanges of the support members 6 of two adjacent panels 2, 2' is formed between the two side portions 40, 42.

Between the second and third portions 32, 34, each steel strip 136 comprises a protrusion portion 44, which extends out away from the interior surface 16*a* of the support panel 16. The protrusion portions 44 are dimensioned such that the protrusion portions 44 of the two adjacent panels 2, 2' are slightly larger than an opening of the channel or groove formed between the two side portions 40, 42. However, connecting strip 24 can resiliently deform sufficiently to allow the protrusion portions 44 of the two adjacent panels 2, 2' to be received in the channel or groove. Once the protrusion portions 44 of the two adjacent panels 2, 2' have passed the two side portions 40, 42, the connecting strip 24 can snap back such that the protrusion portions 44 are held captive in the groove or channel.

At a distal end of the fourth portion 36 of the reinforcing member 20 is provided with a barbed portion 46, which provide with a means for engaging with a face of the central panel 4. The barbed portion 46 is arranged to pierce or penetrate the central panel 4 so as to engage therewith. In this embodiment the barbed portion 46 is formed substantially along the whole length of the reinforcing member 20.

The first portion 30 of each reinforcing member 20 is mechanically attached to the exterior surface 16*b* one of the support panels 16. Similarly, the third portion 34 of each reinforcing member 20 is mechanically attached to the interior surface 16*a* one of the support panels 16. In this embodiment, this is achieved by crimping the first portion 30 of the reinforcing member 20 to the exterior surface 16*b* one of the support panels 16 and crimping the third portion 34 of the reinforcing member 20 to the interior surface 16*a* one of the support panels 16 using tool to punch, clinch or crimp these surfaces together, as will be described further with reference to FIGS. 6A and 6B, at a plurality of positions. As a result, a plurality of dimples or recesses 48 is visible on the exterior surfaces of the first and third portions 138, 142 of the steel strips 136.

Figure 6A:
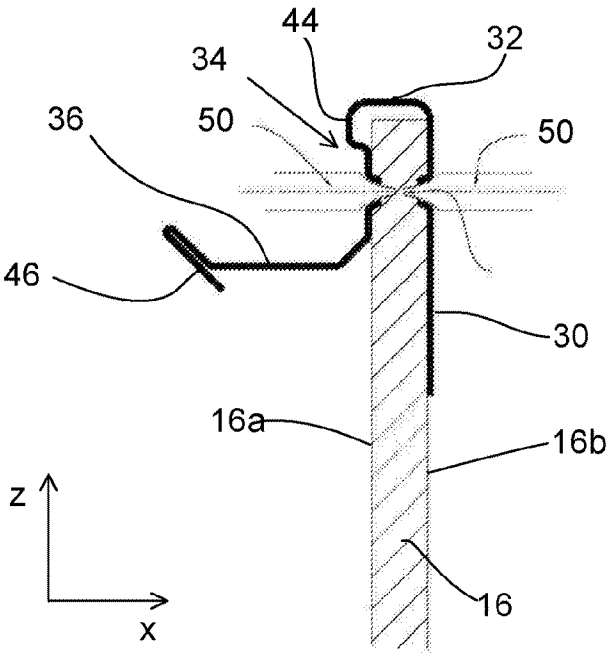
FIG. 6A is a cross-sectional view of the portion of the support member shown in FIG. 5C also showing a tool tip.
Figure 6B:
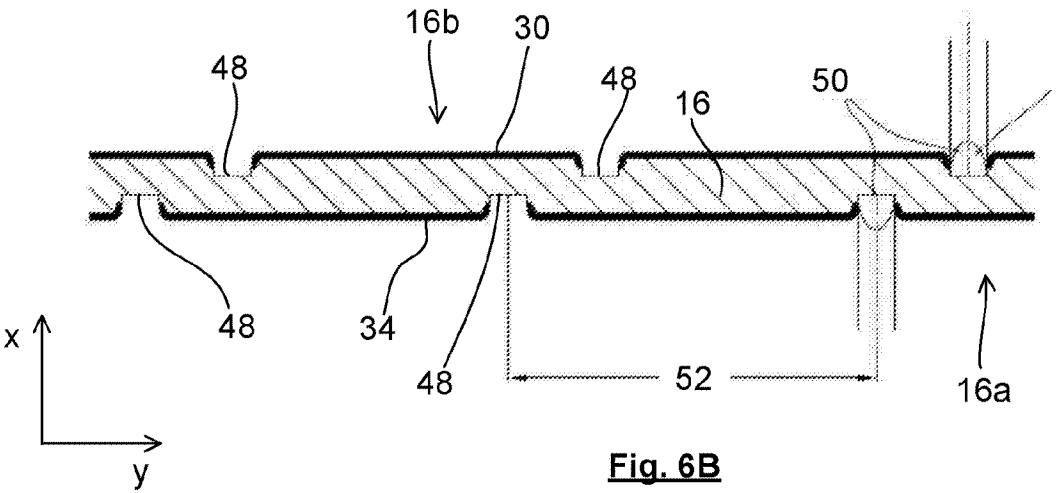
FIG. 6B is a cross-sectional view of the portion of the support member shown in FIG. 5D also showing a tool tip.

FIG. 6A is a cross-sectional view of the support panel 16 and the reinforcing member 20 in the x-z plane and FIG. 6B is a cross-sectional view of the support panel 16 and the reinforcing member 20 in the x-y plane. Also shown schematically in FIGS. 6A and 6B is a tool tip 50.

It will be appreciated that the tool tip 50 is driven into an exterior surface of the first and third portions 30, 34 of the reinforcing member 20 so as to cause plastic deformation of the surfaces of both the first and third portions 30, 34 of the reinforcing member 20 and the support panels 16 (which may be flat prior to said plastic deformation). As a result of this plastic deformation, the surfaces of the first and third portions 30, 34 of the reinforcing member 20 are complementary to and in engagement with the exterior and interior surfaces 16*b*, 16*a* of the support panel respectively.

The tool tip 50 may be generally cylindrical, having a diameter of the order of 4 to 6 mm. However, as can be best seen in FIG. 6A, the tip of the tool tip 50 may taper to a rectangular edge, being similar in shape to a flat screwdriver. The tool tip may be driven in to a depth of the order of 3 to 4 mm. As with previous embodiments, the support panel 16 may have a thickness of the order of 6 mm and the reinforcing member 20 may be a light gauge steel strip having a thickness of the order of 1 mm. A distance 15 between the centres of adjacent recesses 48 (formed by tool tip 50) may be of the order of 40 mm.

As can be best seen in FIG. 6B, the recesses 48 formed on the interior side 16*a* of the support panel 16 are offset in the y direction relative to the recesses 48 formed on the exterior side 16*b* of the support panel 16. It will be appreciated that although two recesses 48 are shown in FIGS. 6A (and 5C) this is merely to indicate that recesses are provided on both sides of the support panel 16 and that in reality these recesses are offset (as in FIGS. 6B and 5D) such that they would not appear in the same cross section in the x-z plane.

In an alternative embodiment, each reinforcing member 20 may be mechanically attached to one of the support panels 16 by one or more fixings. The fixings may be, for example, punches, rivets, screws, nails or the like.

It will be appreciated that the modular partition system 22 can be used to form a partition, with a plurality of adjacent and parallel panels 2, 2' connected together using two connecting strips 24 for each pair of adjacent panels 2, 2'. The two connecting strips 24 being provided at opposite ends of the support members 6 of the two adjacent panels 2, 2'.

In general, the support members 16 and connecting strips 24 span between two supports (for example roof beams) and may be manufactured to the desired length (i.e. the dimension of the panels 2, 2' in the y-direction as shown, for example, FIGS. 1A to 2B) so as to span between the supports.

The panels 2, 2' may be of any width. The width of the panels may be selected bearing in mind both: the amount of support required for the overall structural stability of the panel 2, 2' and/or the requirements of any substrates 26, 28 which, in use, the panels are intended to support (such as, for example, floorboards, plasterboard etc.).

The above-described panel 2 according to an embodiment of the invention is advantageous, since the foam strips 8, 10 allow the panel 2 to be temporarily configured in a smaller, compressed state (as shown in FIGS. 2A and 2B). This is achieved by compressing the foam strips 8, 10 such that the panel 2 can be positioned in a space. Subsequently, the foam strips 8, 10 can return to their equilibrium length and the panel 2 may expand to substantially fill a gap within which it has been installed.

Advantageously, the foam strips 8, 10 (which provide a resiliently compressible portion) allow the panel 2 to be used to account for building tolerances in the manufacture of a partition, as now discussed with reference to FIGS. 7A-7D.

Figure 7A:
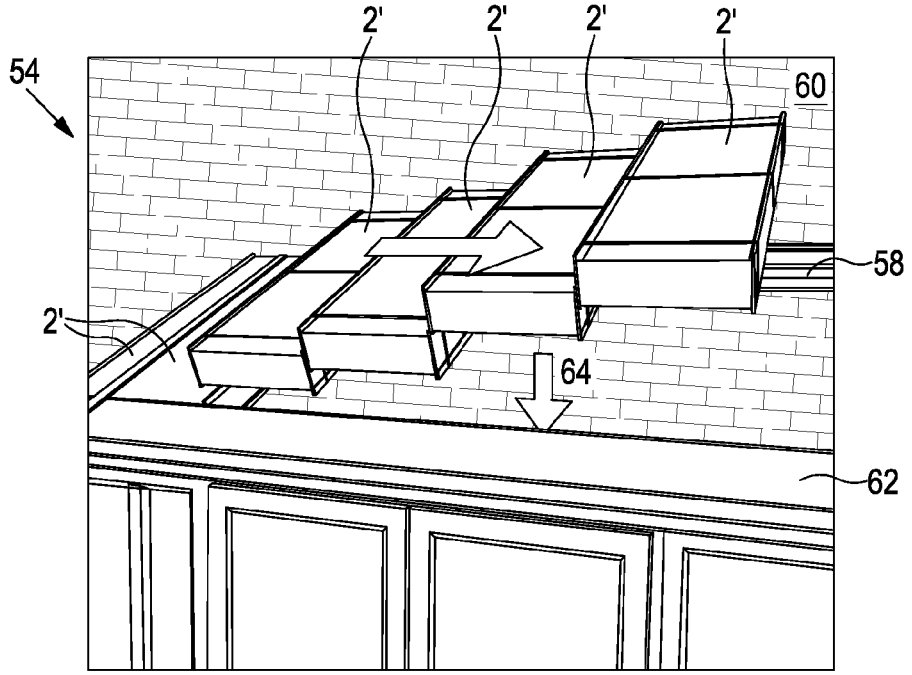
FIG. 7A is a schematic illustration of the installation of roof structure which is an embodiment of the modular partition system shown in FIG. 3.
Figure 7B:
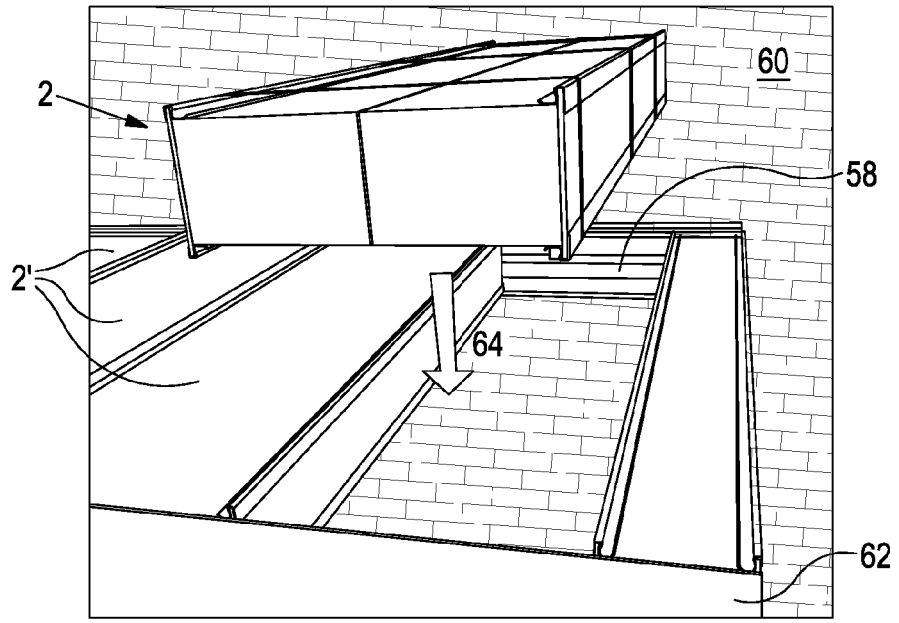
FIG. 7B is a schematic illustration of the installation of a final panel of the roof structure shown in FIG. 7A, the final panel being a panel of the form shown in FIGS. 1A to 2B.

As explained above, the panel 2 shown in FIGS. 1A to 2B can form part of a modular partition system 22. FIGS. 7A to 7B illustrate, schematically, the installation of a lean to roof structure 54 which is an embodiment of such a modular partition system 22, comprising a plurality of panels.

It will be appreciated that the roof structure 54 is used to cover a generally rectangular space 56. Each panel 2, 2' is installed such that each of the two support members 6 is supported at either end by a support object. In particular, in this embodiment of a roof structure 54 the panels are installed (see FIG. 7A) such that the two support members 6 are supported at a first end of the panel 2, 2' by a first support beam 58, which is in turn fixed to a wall 60, and are supported at a second end of the panel 2, 2' by a second support beam 62. Although it cannot be seen in FIGS. 7A-7D, it will be appreciated that the second support beam 62 is provided with a lip or shelf for this purpose. The first and second support beams 58, 62 may be considered to be two supporting objects that are separated in a first direction (the y-direction).

It may be desirable for the panels 2, 2' to substantially fill the space 56 in a second direction that is generally parallel to the first and second support beams 58, 62 and generally perpendicular to the first direction, i.e. the x-direction. It will be appreciated that it may be desired that a sum of the dimensions of all of the panels 2, 2' in the second direction (the x-direction) generally matches the dimensions of the space 56 in this direction. However, generally some building tolerance should be made since, in practice, the desired or required dimension of the space 56 (which is generally dependent on other parts of a building) will not be precisely known. On the one hand, it is desirable that the panels 2, 2' are sufficiently small in the second direction (the x-direction) that all of the panels will fit in the space 56 so that an installer can be confident that they will fit into the space 56 and can actually be installed. On the other hand, it is desirable that the panels 2, 2' are sufficiently large in the second direction (the x-direction) that any gap in the structure formed by the panels 2, 2' is minimised.

As shown in FIG. 7A, each of the panels is installed in turn. This installation is achieved by positioning the panel 2, 2' such that it is above the first and second support beams 58, 62 and then moving the panel downwards towards the first and second support beams 58, 62 in the direction indicated by arrow 64.

As can be seen in FIG. 7B, this roof structure 54 comprises one panel 2 generally of the form shown in FIGS. 2A and 2B. As shown in FIG. 7B, this panel 2 is generally of the form shown in FIGS. 2A and 2B may, for example, be the last panel of the modular partition system 22 to be installed.

The two foam strips 8, 10 allow this panel 2 to be temporarily configured in a smaller, compressed state and held in this state, for example by straps 15 (as shown in FIGS. 2A and 2B). In turn, this allows the panel 2 to be positioned in the space 56 (specifically part of the space that is not already occupied by the other panels 2'). As shown in FIG. 7B, installation of this panel is also achieved by positioning the panel 2 such that it is above the first and second support beams 58, 62 and then moving the panel downwards towards the first and second support beams 58, 62 in the direction indicated by arrow 64.

Figure 7C:
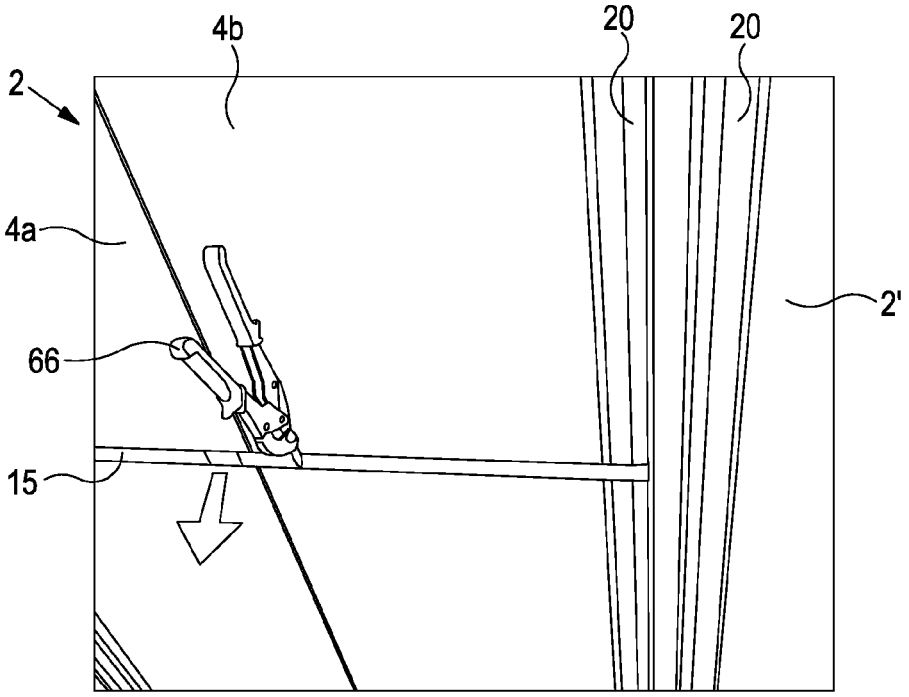
FIG. 7C is a schematic illustration of a retaining strap of the final panel shown in FIG. 7B.
Figure 7D:
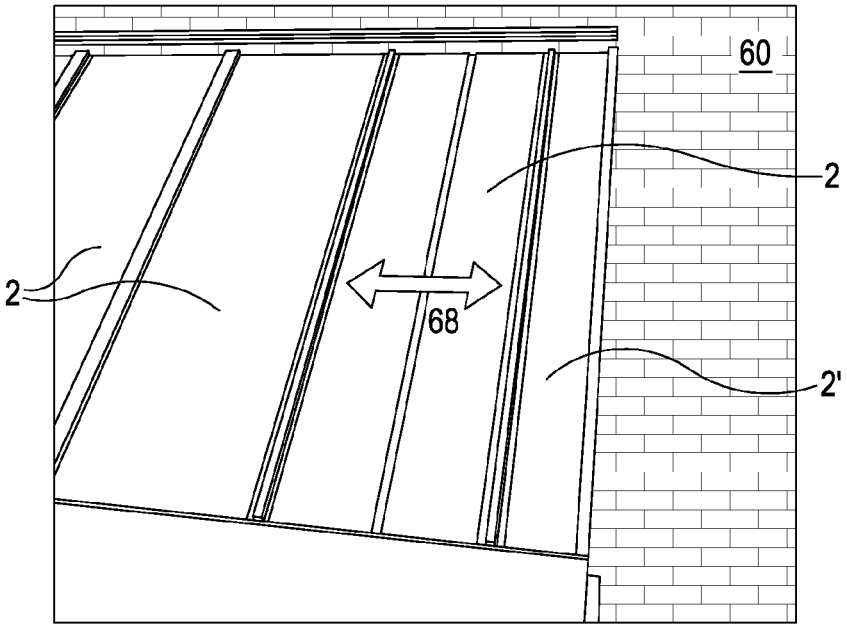
FIG. 7D is a schematic illustration of the expansion of the final panel shown in FIGS. 7B and 7C once the retaining strap has been removed and the final panel has returned to an equilibrium length.

Subsequently, once this panel 2 is in situ (i.e. supported by the first and second support beams 58, 62) the foam strips 8, 10 can be returned to their equilibrium lengths. As indicated in FIG. 7C, this may be achieved by cutting the straps 15, for example using a cutting tool 66. As a result, as indicated by double arrow 68 in FIG. 7D, the panel 2 may expand to substantially fill a gap within which it has been installed.

According to some embodiments of the present invention there is provided a method for installing a panel 2 in a space 56. The method is substantially as described above with reference to FIGS. 7A to 7D. The method may comprise providing a panel 2 generally of the form shown in FIGS. 1A-2D; positioning the panel 2 in the space 56;

and then allowing the foam strips 8, 10 to return to their equilibrium lengths.

While specific embodiments of the invention have been described above, it will be appreciated that the invention may be practiced otherwise than as described. The descriptions above are intended to be illustrative, not limiting. Thus it will be apparent to one skilled in the art that modifications may be made to the invention as described without departing from the scope of the claims set out below.

The invention claimed is:

1. A panel for forming part of a partition, the panel comprising:

a central panel;

two support members disposed on opposed sides of the central panel, each of the two support members extending generally perpendicularly to a plane of the central panel; and a resiliently compressible portion arranged between the two support members such that a distance between the two support members can be reduced by compressing the resiliently compressible portion, wherein a protruding portion of each of the two support members extends beyond each of the faces of the central panel and wherein the panel further comprises a reinforcing member on each of the protruding portions of the support members.

2. The panel of claim 1 wherein the central panel comprises two parts and wherein the resiliently compressible portion is arranged between said two parts of the central panel.

3. The panel of claim 1 wherein the resiliently compressible portion is arranged between two parts of the panel and wherein the resiliently compressible portion is substantially sealed to each of said two parts of the panel.

4. The panel of claim 1 wherein the resiliently compressible portion comprises one or more foam strips that are disposed between, and adhered to, two other parts of the panel.

5. The panel of claim 4 wherein the one or more foam strips comprises two foam strips, each of the two foam strips being disposed adjacent a different one of two opposed surfaces of the panel.

6. The panel of claim 1 further comprising a retaining means for retaining the resiliently compressible portion in a compressed state.

7. The panel of claim 6 wherein the resiliently compressible portion is maintained in the compressed state by the retaining means.

8. The panel of claim 6 wherein the retaining means comprises one or more straps.

9. The panel of claim 1 wherein the central panel comprises a thermally insulating material.

10. The panel of claim 1 wherein the two support members each comprise a support panel extending generally perpendicularly to a plane of the central panel.

11. The panel of claim 1 wherein a side surface of either or both of the support members is provided with a resilient sealing material.

12. A modular partition system comprising:

a plurality of panels, each of the plurality of panels comprising two support members extending generally perpendicularly to a plane of the modular partition system and a central panel extending between said two support panels, the plurality of panels being arranged such that the central panels of each of the plurality of panels are generally mutually parallel and one support member of each of the plurality of panels is adjacent to a support member of an adjacent panel; and at least one connecting strip;

wherein the at least one connecting strip cooperates with a support member from each of two of the plurality of adjacent panels so as to connect said two of the plurality of adjacent panels; and wherein at least one of the plurality of panels is a panel according to claim 1.

13. A method for installing a panel in a space, the method comprising:

providing a panel, the panel comprising:

a central panel;

two support members disposed on opposed sides of the central panel, each of the two support members extending generally perpendicularly to a plane of the central panel; and a resiliently compressible portion arranged between the two support members such that a distance between the two support members can be reduced by compressing the resiliently compressible portion;

compressing the resiliently compressible portion;

positioning the panel in the space; and allowing the resiliently compressible portion to return to its equilibrium length, wherein a protruding portion of each of the two support members extends beyond the faces of the central panel and the panel further comprises a plurality of reinforcing members on each of the protruding portions of the support members.

* * * * *